US005134859A

United States Patent [19]

Jaster

[11] Patent Number: 5,134,859

[45] Date of Patent: Aug. 4, 1992

[54] EXCESS REFRIGERANT ACCUMULATOR FOR MULTIEVAPORATOR VAPOR COMPRESSION REFRIGERATION CYCLES

[75] Inventor: Heinz Jaster, Schenectady, N.Y.

[73] Assignee: General Electric Company, Schenectady, N.Y.

[21] Appl. No.: 677,075

[22] Filed: Mar. 29, 1991

[51] Int. Cl.[5] ..... F25B 43/00

[52] U.S. Cl. ..... 62/503; 62/198; 62/510

[58] Field of Search ..... 62/198, 503, 510

[56] References Cited

U.S. PATENT DOCUMENTS

| | | | |
|---|---|---|---|
| 2,500,688 | 3/1950 | Kellie | 62/115 |
| 2,519,010 | 8/1950 | Zearfoss | 62/115 |
| 2,539,908 | 1/1951 | Jenkins | 62/8 |
| 2,590,741 | 3/1952 | Watkins | 62/503 |
| 2,667,756 | 2/1954 | Atchison | 62/8 |
| 2,719,407 | 10/1955 | Zearfoss | 62/6 |
| 2,844,945 | 7/1958 | Muffly | 62/160 |
| 2,966,043 | 12/1960 | Ross | 62/503 |
| 3,064,446 | 11/1962 | Dodge | 62/175 |
| 3,360,958 | 1/1968 | Miner | 62/470 |
| 4,179,898 | 12/1979 | Vakil | 62/503 |
| 4,317,335 | 3/1982 | Nakagawa et al. | 62/199 |
| 4,340,404 | 7/1982 | Oonishi | 62/198 |
| 4,474,026 | 10/1984 | Mochizuki et al. | 62/157 |
| 4,513,581 | 4/1985 | Mizobuchi et al. | 62/197 |
| 4,644,756 | 2/1987 | Sugimoto et al. | 62/160 |
| 4,651,540 | 3/1987 | Morse | 62/503 |
| 4,862,707 | 9/1989 | Hill et al. | 62/431 |
| 4,910,972 | 3/1990 | Jaster | 62/335 |
| 4,918,942 | 4/1990 | Jaster | 62/335 |
| 4,966,010 | 10/1990 | Jaster et al. | 62/179 |

FOREIGN PATENT DOCUMENTS

| | | |
|---|---|---|
| 192526 | 1/1986 | European Pat. Off. . |
| 431893 | 11/1911 | France . |
| 2295374 | 6/1974 | France . |
| 10577533 | 11/1983 | U.S.S.R. . |

OTHER PUBLICATIONS

"Refrigeration and Air Conditioning," W. F. Stoecker, McGraw-Hill Series in Mechanical Engineering, N.Y. May 1958, pp. 56-61.

"Heat Pumps—Limitations and Potential," J. B. Comly et al., General Electric Technical Information Series, Report No. 75CRD185, Sep. 1975, pp. 7, 8 and 18.

"Principles of Refrigeration," R. J. Dossat, John Wiley and Sons, N.Y. May 1976, pp. 240, 241, 430 and 536.

*Primary Examiner*—Ronald C. Capossela

*Attorney, Agent, or Firm*—Patrick R. Scanlon; James C. Davis, Jr.; Paul R. Webb, II

[57] ABSTRACT

An excess liquid refrigerant accumulator for multievaporator refrigeration systems is provided. Under some operating conditions, the lowest temperature evaporator of a multievaporator system may discharge some liquid refrigerant rather than only vapor refrigerant. This liquid discharge creates a loss of cooling capacity. A receptacle connected to the exit of the lowest temperature evaporator accumulates the liquid. By locating the receptacle within the cooled compartment, the cooling capacity which would otherwise be lost, is regained.

14 Claims, 5 Drawing Sheets

EXCESS REFRIGERANT ACCUMULATOR FOR MULTIEVAPORATOR VAPOR COMPRESSION REFRIGERATION CYCLES

CROSS REFERENCES TO RELATED APPLICATIONS

This application is related to the following copending applications: "Refrigeration System Including Capillary Tube/Suction Line Heat Transfer," Ser. No. 7/612,051, filed Nov. 9, 1990; "Refrigeration System and Refrigeration Control Apparatus Therefor," Ser. No. 7/612,290, filed Nov. 9, 1990; and "Refrigeration Systems with Multiple Evaporators," Ser. No. 07/677,074, filed concurrently herewith. All of these related applications are assigned to the same assignee as the present invention.

BACKGROUND OF THE INVENTION

This invention relates generally to refrigeration systems and more particularly concerns placement of an accumulator in a multievaporator refrigeration cycle to increase the efficiency thereof.

Conventional refrigeration systems used in household refrigerators operate on the simple vapor compression cycle. Such a cycle includes a compressor, a condenser, an expansion throttle, and an evaporator connected in series and charged with a refrigerant. A conventional household refrigerator, of course, has two food compartments, the freezer and the fresh food compartment. The freezer is generally maintained between −10° F. and +15° F., the fresh food compartment is preferably maintained between about +33° F. and +47° F. To meet these requirements, the evaporator of the typical system is operated at approximately −10° F. The refrigeration effect is captured by blowing air across the evaporator. This air flow is controlled so that a portion of the air flow is directed into the freezer and the remainder is directed into the fresh food compartment. Thus, the refrigeration cycle produces its refrigeration effect at a temperature which is appropriate for the freezer but lower than necessary for the fresh food compartment. Since more mechanical energy is required for cooling at lower temperatures, the refrigeration system described above uses more mechanical energy than one that produces cooling at two temperature levels. However, the well known procedure of employing two independent refrigeration cycles, one to serve the freezer at a low temperature and another one to serve the fresh food compartment at a slightly higher temperature, is a very costly solution to this problem.

A refrigeration system suitable for use in a household refrigerator and having improved thermodynamic efficiency is described in U.S. Pat. No. 4,910,972, which is assigned to the same assignee as the present invention. A system disclosed in U.S. Pat. No. 4,910,972 is shown in FIG. 1. The system comprises a first expansion valve 11, a first evaporator 13, first and second compressors 15 and 17, a condenser 21, a second expansion valve 23, and a second evaporator 25 connected in series in a refrigerant flow relationship by a conduit 26. A phase separator 27 is connected to the outlet of the second evaporator 25 to receive two phase refrigerant therefrom. The phase separator provides liquid refrigerant to the first expansion valve 11 and saturated vapor refrigerant to second compressor 17. The first evaporator is operated at approximately −10° F. and cools the freezer; the second evaporator is operated at approximately 25° F. and cools the fresh food compartment. Thus, this dual evaporator two stage cycle uses much less mechanical energy than the typical single evaporator system.

The above-mentioned related applications, Ser. No. 07/612,051 and 07/612,290, disclose other refrigeration systems having improved thermodynamic efficiency. A system representative of a system disclosed in these applications is shown in FIG. 2. The system of FIG. 2 is similar to that of FIG. 1. However, one difference is that instead of using a multistage compressor unit, the system of FIG. 2 uses a single compressor Particularly, the system comprises a first expansion valve 31, a first evaporator 32, a compressor 33, a condenser 34, a second expansion valve 35, and a second evaporator 36 connected in series in a refrigerant flow relationship by a conduit 37. A phase separator 38 is connected to the outlet of the second evaporator 36 to receive two phase refrigerant therefrom. The phase separator provides liquid refrigerant to the first expansion valve 31 and saturated vapor refrigerant to a refrigerant flow control unit 39. The control unit, which is also connected to the outlet of the first evaporator 32 and the inlet of the compressor 33, selectively allows either refrigerant from the first evaporator 32 or vapor refrigerant from the phase separator 38 to flow to the compressor 33. This system improves efficiency without using multiple compressor stages.

In the multievaporator systems described above, excess refrigerant inventory is normally accumulated in the phase separators. Liquid refrigerant is supplied from the phase separator to the lowest temperature evaporator via an expansion throttle Ideally, the refrigerant will be completely vaporized in the evaporator. However, when the lowest temperature evaporator operates at a temperature which is lower than its design temperature, either due to decreased thermal load or compartment thermostat setting, the refrigerant is not completely vaporized and some refrigerant is discharged from the evaporator as liquid. This liquid refrigerant is effectively stored in the suction line between the lowest temperature evaporator and the compressor unit. Liquid discharge to the suction line represents a loss of cooling capacity because the cooling produced by the evaporation of refrigerant in the suction line is released to the ambient and not the cooled compartment. Also, liquid discharge from the lowest temperature evaporator effectively transfers liquid refrigerant inventory from the phase separator to the suction line Eventually, the phase separator will discharge two-phase refrigerant instead of liquid refrigerant. Consequently, the flow rate through the expansion throttle will decrease.

SUMMARY OF THE INVENTION

Accordingly, it is an object of the present invention to provide a multievaporator refrigeration system having a means for regaining lost cooling capacity These and other objects are accomplished in the present invention by providing a multievaporator refrigeration system for use in a refrigerator having a plurality of compartments being maintained at different temperatures in which a cooling capacity regaining device such as an excess refrigerant accumulator is disposed within the lowest temperature compartment to receive refrigerant from the lowest temperature evaporator. The accumulator comprises a receptacle for accumulating liquid refrigerant in a lower portion and gas refrigerant in an upper portion The receptacle has an aperture in the top for receiving refrigerant from the lowest temperature evaporator and an outlet for supplying gas refrigerant to a compressor unit. The outlet comprises a tube extending from a point near the top of the receptacle and through an aperture in the bottom. Systems having multiple evaporators can be utilized. The compressor unit can comprise either a number of compressor stages equal to the number of evaporators or a single compressor and a refrigerant flow control unit such as that described above in conjunction with the system of FIG. 2.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

The present invention, as described herein, is believed to have its greatest utility in household refrigerators. However, the present invention has utility in other refrigeration applications such as air conditioning. Thus, the term refrigeration systems, as used herein, is not limited to only refrigerators/freezers but may also pertain to many other refrigeration applications.

Figure 1:
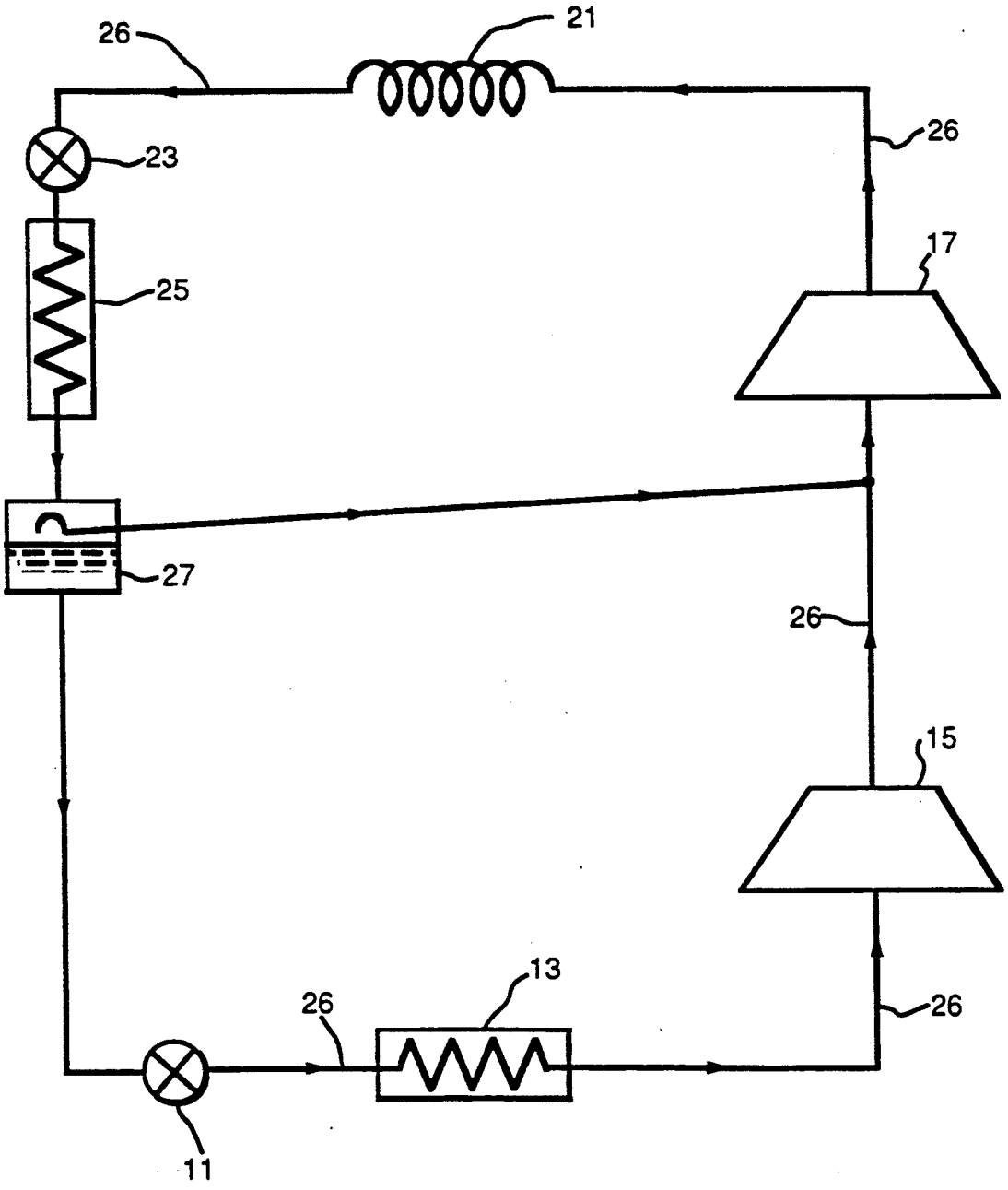
FIG. 1 ( PRIOR ART )
FIG. 1 is a schematic representation of a prior art refrigeration system.
Figure 2:
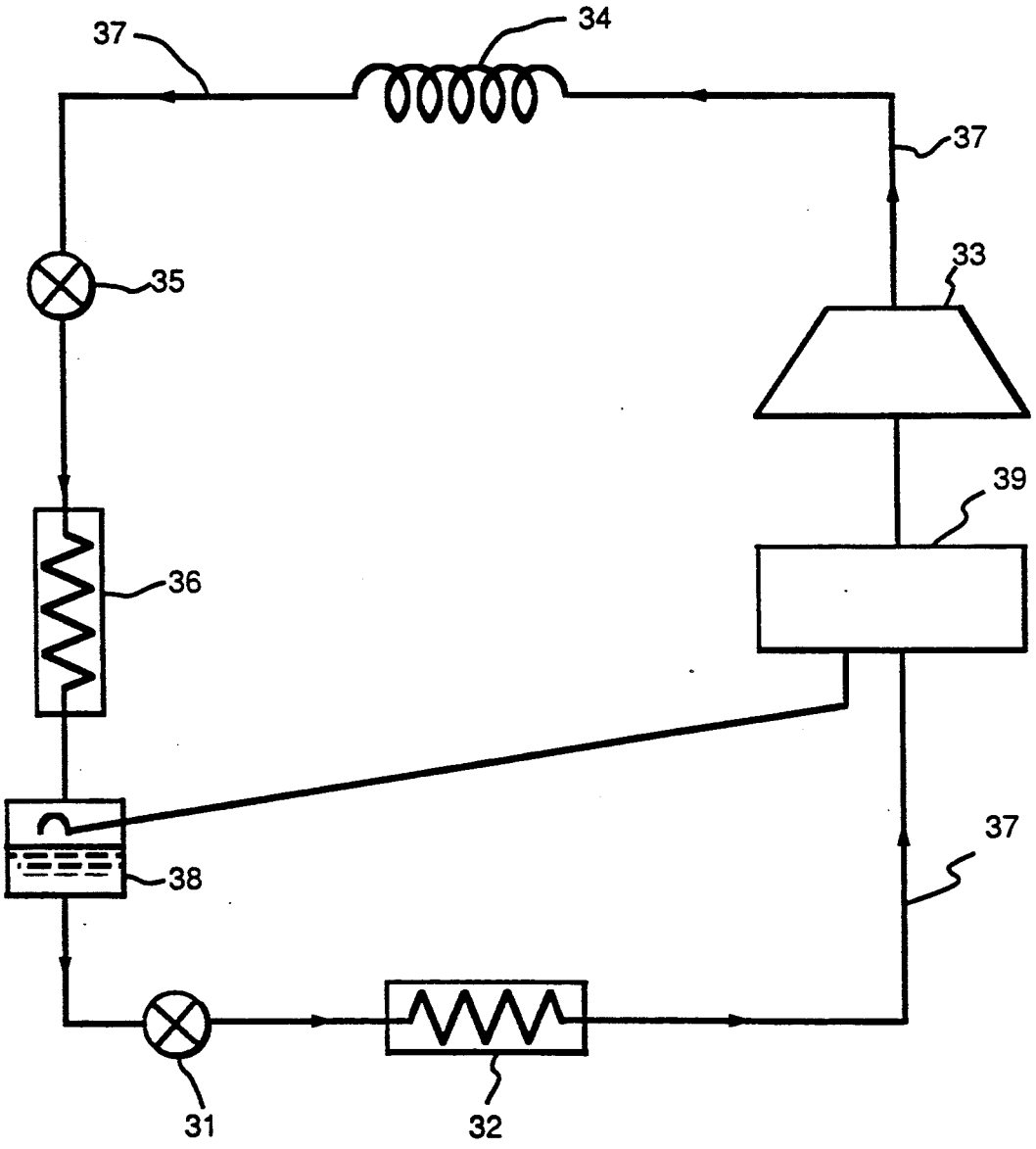
FIG. 2 ( PRIOR ART )
FIG. 2 is a schematic representation of another prior art refrigeration system.
Figure 3:
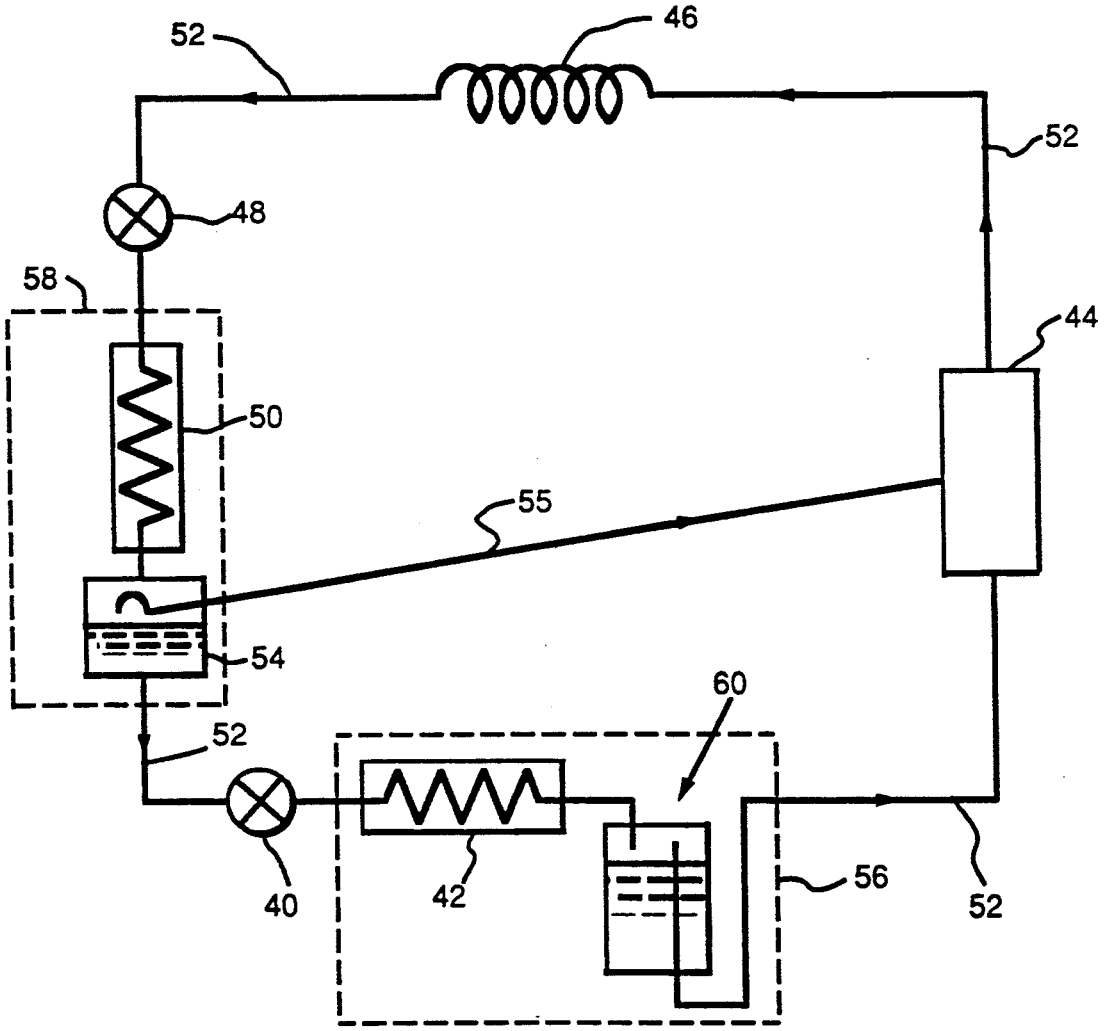
FIG. 3 is a schematic representation of a first preferred embodiment of a multievaporator refrigeration system having an excess liquid refrigerant accumulator in accordance with the present invention.

Referring now to FIG. 3, a refrigeration system representing a preferred embodiment of the present invention is shown. The system comprises a first expansion throttle 40, a first evaporator 42, a compressor unit 44, a condenser 46, a second expansion throttle 48, and a second evaporator 50, connected together in that order, in series, in a refrigerant flow relationship by a conduit 52. As used herein, the term "expansion throttle" refers to any device, such as an orifice, an expansion valve or a capillary tube, which reduces the pressure of refrigerant passing therethrough. In a manner not shown, one or both of the expansion throttles may be placed in a heat exchange relationship with the suction line. A phase separator 54 comprising a closed receptacle is provided. The phase separator 54 includes an inlet at its upper portion for admitting liquid and gaseous phase refrigerant from the second evaporator 50. The receptacle accumulates liquid refrigerant in a lower portion and gaseous refrigerant in an upper portion. A first outlet located at the bottom of the receptacle supplies liquid refrigerant to the first evaporator 42 via the conduit 52 and the first expansion throttle 40. The phase separator also has a second outlet which supplies vapor refrigerant to the compressor unit 44. The second outlet is provided by a conduit 55 which extends from the exterior of the upper portion of the receptacle to the exterior. The conduit 55 is in flow communication with the upper portion and is so arranged that liquid refrigerant cannot enter its open end.

The first evaporator 42 is situated within a freezer compartment 56, and the second evaporator 50 is situated within a fresh food compartment 58. In operation, the first evaporator contains refrigerant at a temperature of approximately −10° F. for cooling the freezer compartment 56. The second evaporator contains the refrigerant at a temperature of approximately 25° F. for cooling the fresh food compartment 58.

The compressor unit 44 can either comprise two compressors as disclosed in U.S. Pat. No. 4,910,972, described above, or a single compressor and a refrigerant flow control unit as disclosed in related applications Ser. No. 07/612,051 and 07/612,290, described above. U.S. Pat. No. 4,910,972 and related applications Ser. No. 07/612,051 and 07/612,290 are herein incorporated by reference. If two compressors are employed, the vapor refrigerant supplied through the conduit 55 is combined with gas exiting the first stage compressor, and the resulting mixture is supplied to the second stage compressor. If a single compressor and a refrigerant flow control unit are used, the vapor refrigerant provided through the conduit 55 is supplied to the control unit and the control unit selectively supplies either that vapor refrigerant or refrigerant exiting the first evaporator 42 to the single compressor.

To the extent described so far, the present system resembles the prior systems described above. As discussed above, these prior systems were susceptible to the problem of liquid refrigerant discharge from the lowest temperature evaporator. That is, refrigerant is normally completely vaporized in the evaporator. However, when the lowest temperature evaporator operates at a temperature which is lower than its design temperature, either due to decreased thermal load or compartment thermostat setting, the refrigerant is not completely vaporized and some refrigerant is discharged from the evaporator as liquid. This liquid discharge to the suction line represents a loss of cooling capacity because the cooling produced by the evaporation of refrigerant in the suction line is released to the ambient and not the cooled compartment.

Figure 4:
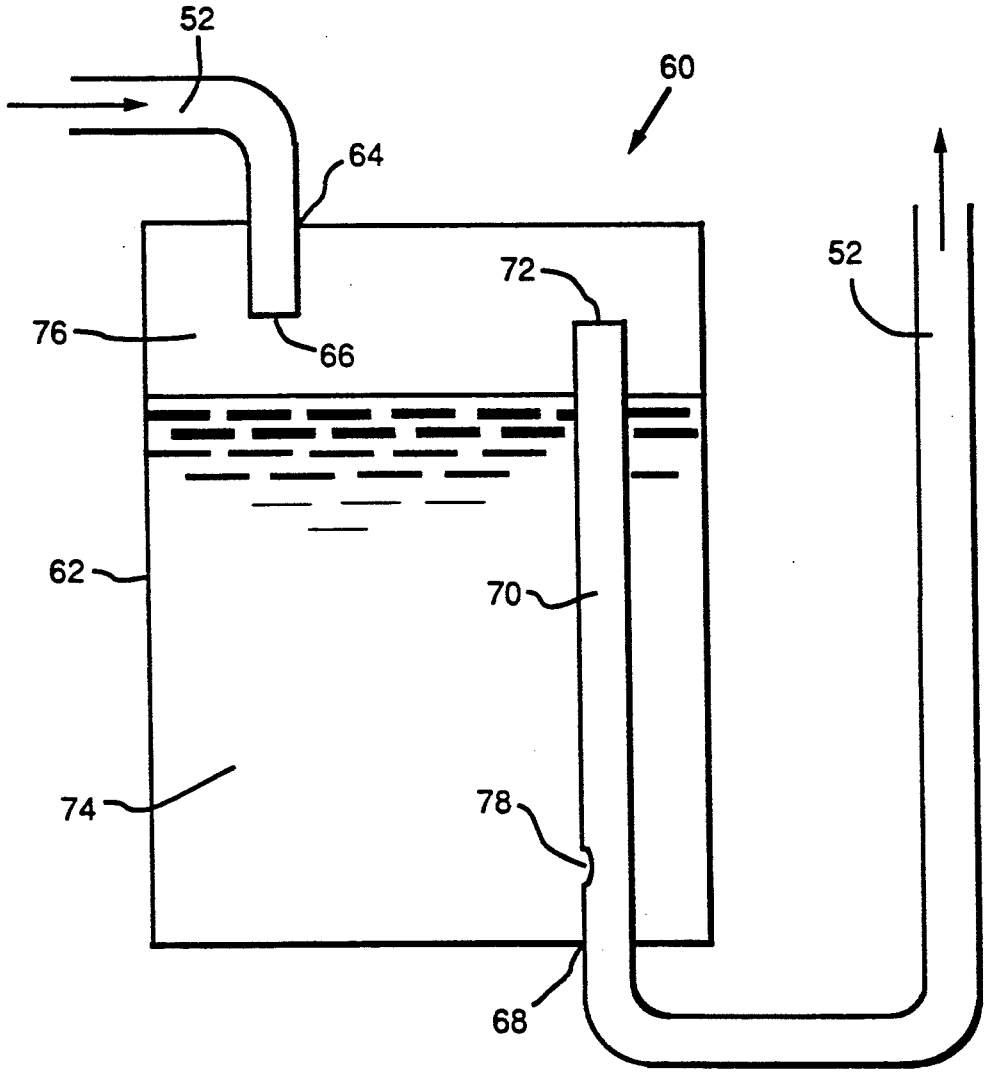
FIG. 4 is a schematic representation of an excess liquid refrigerant accumulator in accordance with the present invention.

To regain this lost cooling capacity, the present invention provides a cooling capacity regaining device, in the form of an accumulator 60, to the system. The accumulator 60 is connected to the outlet of the first evaporator 42 and is disposed within the freezer compartment 56. As seen in FIG. 4, the accumulator comprises a closed receptacle 62. The receptacle must be of sufficient size to hold all excess liquid refrigerant that exists within the cycle at operating conditions. The receptacle 62 receives refrigerant discharged from the first evaporator 42 through an inlet in the top of the receptacle. The inlet comprises an aperture 64 in the top of the receptacle 62 through which the portion of the conduit 52 connecting the accumulator and the first evaporator extends. The conduit 52 terminates in an open end 66 a short distance within the receptacle 62. An outlet from the receptacle 62 is also provided The outlet comprises an aperture 68 in the bottom of the receptacle and an exit tube 70 which extends from the interior of the receptacle to the exterior via the aperture 68. The end of the exit tube 70 which is located within the receptacle 62 comprises an open end 72 located near the top of the receptacle. Outside of the receptacle 62, the exit tube 70 is connected with the portion of the main conduit 52 which is connected to the compressor unit 44. This portion of the conduit 52 is also known as the suction line.

In operation, refrigerant discharged from the first evaporator 42 enters the receptacle 62 via the inlet. When the first evaporator is operating at lower than design temperature, the refrigerant entering the receptacle is in liquid and vapor form. The liquid refrigerant accumulates in a lower portion 74 of the receptacle, while the vapor refrigerant occupies an upper portion 76. Due to its position near the top of the receptacle, the open end 72 of the exit tube 70 only passes vapor refrigerant therethrough. Thus, liquid refrigerant is not passed to the suction line and all excess liquid refrigerant which is discharged from the first evaporator 42 is stored in the accumulator 60 and not the suction line. Because the accumulator is situated within the freezer compartment 56, excess liquid refrigerant cannot be evaporated externally of the freezer compartment and no cooling capacity is lost due to liquid refrigerant discharge from the evaporator.

The accumulator 60 is useful when liquid refrigerant is discharged from the first evaporator 42. Under normal operating conditions, however, only superheated vapor is discharged from the first evaporator. The liquid refrigerant stored in the accumulator will eventually be evaporated and the accumulator will be void of liquid refrigerant. (Under such conditions, the phase separator holds the entire inventory of excess liquid refrigerant.) An internal line transport bleeder hole 78 is provided in the exit tube 70 near the bottom of the receptacle 62 to prevent lubricant hold-up in the accumulator in this case.

Figure 5:
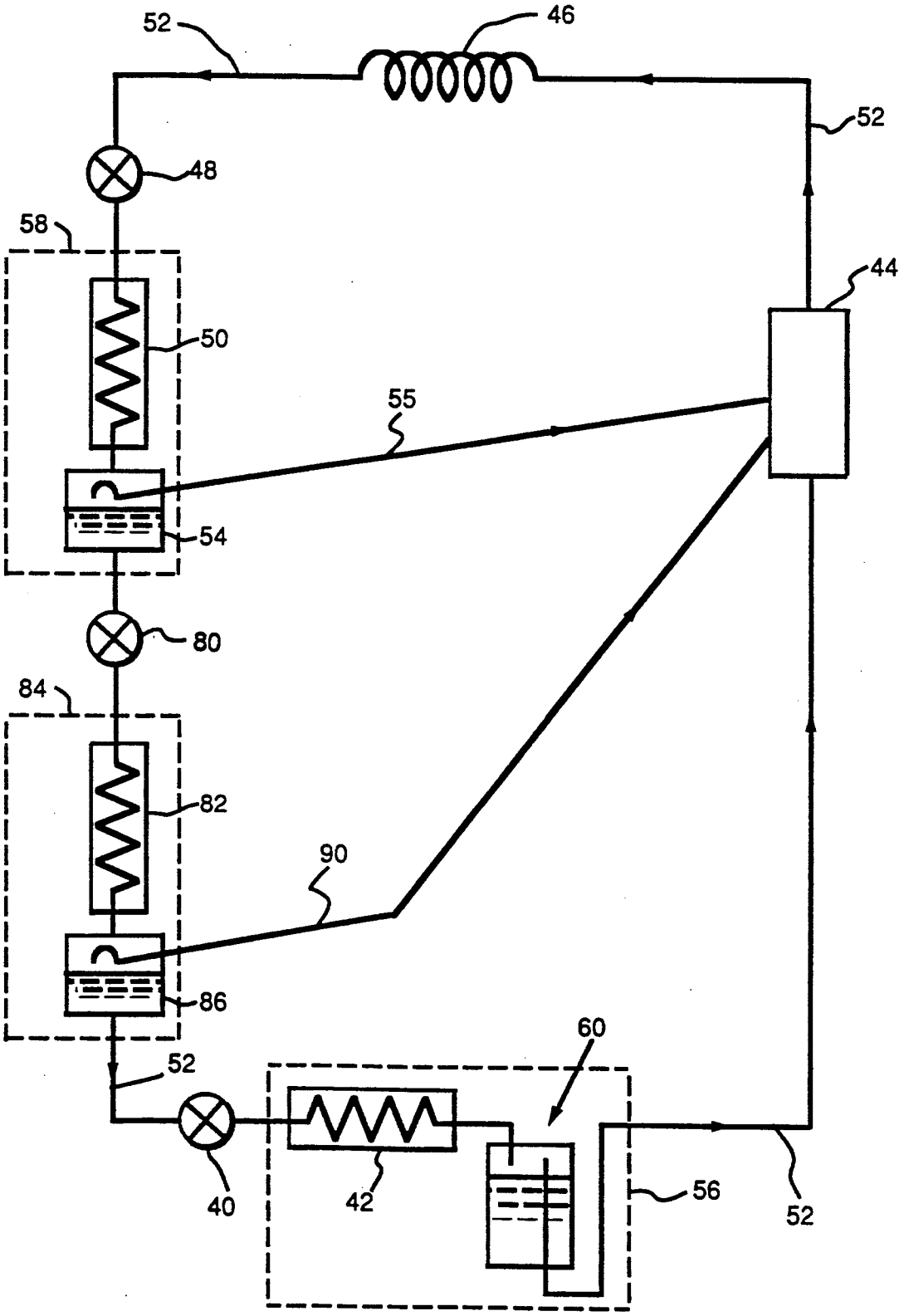
FIG. 5 is a schematic representation of another preferred embodiment of a multievaporator refrigeration system having an excess liquid refrigerant accumulator in accordance with the present invention.

Although household refrigerators typically have two food compartments, there is some interest in providing refrigerators with three distinct compartments. Such an arrangement would require three evaporators. Other refrigeration applications may also require three separate evaporators. FIG. 5 shows an embodiment of the present invention in which a refrigeration system having three evaporators is provided. The system of FIG. 5 is essentially the system shown in FIG. 3 (like elements are given like reference characters) with the addition of a third expansion throttle 80, a third evaporator 82 for cooling an intermediate compartment 84, and a second phase separator 86. A compressor unit 88 either having three compressor stages or a single compressor and a three-way refrigerant flow control unit is utilized. A conduit 90 supplies vapor refrigerant from the second phase separator 86 to the compressor unit 88.

As in the previous embodiment, the accumulator 60 is disposed at the exit of the first evaporator 42 within the freezer compartment 56. By holding excess liquid refrigerant in the freezer compartment, the accumulator 60 prevents a loss of cooling capacity due to liquid refrigerant discharge from the lowest temperature evaporator.

The foregoing has described a multievaporator refrigeration system which has improved thermodynamic efficiency due to a means of regaining lost cooling capacity. Refrigeration cycles having either two or three evaporators are disclosed. However, systems having even more than three evaporators are possible. Either single stage or multistage compressor units may be used.

While specific embodiments of the present invention have been described, it will be apparent to those skilled in the art that various modifications thereto can be made without departing from the spirit and scope of the invention as defined in the appended claims.

I claim:

1. In a multievaporator refrigeration apparatus including a lowest temperature compartment and a first evaporator located within the lowest temperature compartment, an excess refrigerant accumulator connected to the output of the first evaporator for accumulating liquid refrigerant, said excess refrigerant accumulator being situated within the lowest temperature compartment.

2. The accumulator of claim 1 further comprising a receptacle for accumulating liquid refrigerant in a lower portion and gas refrigerant in an upper portion.

3. In a refrigeration apparatus having at least one compressor, a low temperature compartment and a low temperature evaporator for cooling the low temperature compartment, a cooling capacity regaining device comprising:

an excess refrigerant receptacle for accumulating liquid refrigerant in a lower portion and gas refrigerant in an upper portion, said excess refrigerant receptacle being disposed within the low temperature compartment;

an inlet means for receiving refrigerant from the low temperature evaporator; and an outlet means for supplying gas refrigerant to the at least one compressor.

4. The cooling capacity regaining device of claim 3 wherein said inlet means comprises an aperture in the top of said receptacle and said outlet means comprises a tube extending from a point in the upper portion of said receptacle and through an aperture in the bottom of said receptacle.

5. The cooling capacity regaining device of claim 4 further comprising a bleeder hole located in said tube near the bottom of said receptacle.

6. A refrigeration system for use in a refrigerator having a plurality of compartments, each compartment being maintained at a different temperature comprising:

a first evaporator for providing cooling to the coldest of the plurality of compartments;

at least one compressor connected in a refrigerant flow relationship with said first evaporator; and an excess refrigerant accumulator connected to the output of the first evaporator for accumulating liquid refrigerant, said excess refrigerant accumulator being situated within the coldest of the plurality of compartments.

7. The refrigeration system of claim 6 wherein said accumulator further comprises a receptacle for accumulating liquid refrigerant in a lower portion and gas refrigerant in an upper portion.

8. The refrigeration system of claim 6 further comprising a second evaporator for providing cooling to a second one of the plurality of compartments.

9. The refrigeration system of claim 8 further comprising a third evaporator for providing cooling to a third one of the plurality of compartments.

10. A refrigeration system for use in a refrigerator having a plurality of compartments, each compartment being maintained at a different temperature comprising:

a first evaporator for providing cooling to the coldest of the plurality of compartments;

at least one compressor connected in a refrigerant flow relationship with said first evaporator; and a cooling capacity regaining device comprising an excess refrigerant receptacle for accumulating liquid refrigerant in a lower portion and gas refrigerant in an upper portion, said excess refrigerant receptacle being disposed within the coldest of the plurality of compartments, an inlet means for receiving refrigerant from the low temperature evaporator, and an outlet means for supplying gas refrigerant to the compressor.

11. The refrigeration system of claim 10 wherein said inlet means comprises an aperture in the top of said receptacle and said outlet means comprises a tube extending from a point in the upper portion of said receptacle and through an aperture in the bottom of said receptacle.

12. The refrigeration system of claim 11 further comprising a bleeder hole located in said tube near the bottom of said receptacle.

13. The refrigeration system of claim 10 further comprising a second evaporator for providing cooling to a second one of the plurality of compartments.

14. The refrigeration system of claim 13 further comprising a third evaporator for providing cooling to a third one of the plurality of compartments.

* * * * *